US007080600B2

(12) United States Patent
Jurdens

(10) Patent No.: US 7,080,600 B2
(45) Date of Patent: Jul. 25, 2006

(54) PALLET SYSTEM AND METHOD

(75) Inventor: Karl Jurdens, Waterloo (CA)

(73) Assignee: BES Tool & Die Ltd., Cambridge (CA)

( * ) Notice: Subject to any disclaimer, the term of this patent is extended or adjusted under 35 U.S.C. 154(b) by 401 days.

(21) Appl. No.: 10/379,573

(22) Filed: Mar. 6, 2003

(65) Prior Publication Data

US 2004/0173126 A1 Sep. 9, 2004

(51) Int. Cl.
*B65D 19/44* (2006.01)

(52) U.S. Cl. ..... 108/55.1; 108/53.1

(58) Field of Classification Search ..... 108/55.1, 108/55.5, 53.1, 53.3, 53.5, 54.1; 294/67.1, 294/67.2, 68.1
See application file for complete search history.

(56) References Cited

U.S. PATENT DOCUMENTS

| | | | | | |
|---|---|---|---|---|---|
| 1,522,707 | A | * | 1/1925 | Andrews et al. | 108/55.1 |
| 1,555,022 | A | * | 9/1925 | Proctor | 108/55.1 |
| 1,637,960 | A | * | 8/1927 | Romine | 108/55.1 |
| 1,836,362 | A | * | 12/1931 | Crowley | 108/55.1 |
| 2,956,763 | A | | 10/1960 | D'Arca | |
| 3,478,995 | A | * | 11/1969 | Lautzenhiser et al. | 108/55.5 |
| 3,626,872 | A | * | 12/1971 | Cully | 108/55.1 |
| 3,664,273 | A | | 5/1972 | Howe | |
| 3,669,293 | A | | 6/1972 | Bryan et al. | |
| 4,000,923 | A | | 1/1977 | Baldwin | |
| 4,056,195 | A | | 11/1977 | Keith | |
| 4,290,370 | A | * | 9/1981 | Gallagher et al. | 108/53.5 |
| 4,493,604 | A | | 1/1985 | Walker | |
| 4,571,141 | A | | 2/1986 | Gieson | |
| 4,915,033 | A | * | 4/1990 | Bond | 108/55.1 |
| 4,977,836 | A | * | 12/1990 | Bond | 108/55.1 |
| 5,233,931 | A | | 8/1993 | McCorkle, Jr. | |
| 5,297,485 | A | * | 3/1994 | Bond | 108/55.1 |
| 5,388,532 | A | * | 2/1995 | Wakano | 108/55.1 |
| 5,692,625 | A | | 12/1997 | Filipescu et al. | |
| 5,918,551 | A | | 7/1999 | Liu | |
| 6,089,633 | A | | 7/2000 | Jacob | |
| 6,279,763 | B1 | | 8/2001 | Bush | |
| 6,286,792 | B1 | | 9/2001 | Best | |
| 6,325,224 | B1 | | 12/2001 | Brown | |
| 6,811,131 | B1 | * | 11/2004 | Kuo | 248/346.03 |

FOREIGN PATENT DOCUMENTS

GB 2004525 A * 9/1977

* cited by examiner

*Primary Examiner*—José V. Chen

(57) ABSTRACT

A pallet system for maintaining a stack of substantially uniform workpieces in alignment with each other. The stack has at least three side planes defined by sides of the workpieces. The pallet system includes a pallet having a base, and a rigid stake and an adjustable stake projecting upwardly from the base. The base includes a frame supporting a plurality of base members for supporting the stack of workpieces. The rigid stake is adapted to locate a first side plane of the stack in a first predetermined position in relation to the base. The adjustable stake is adapted to locate a second side plane of the stack in a second predetermined position in relation to the base. The rigid stake is spaced from the adjustable stake so that the stack is located in a selected position on the base between the rigid stake and the adjustable stake.

12 Claims, 10 Drawing Sheets

PALLET SYSTEM AND METHOD

FIELD OF THE INVENTION

The present invention relates to a pallet system for maintaining a stack of substantially uniform workpieces in alignment with each other.

BACKGROUND OF THE INVENTION

Pallets of various designs are known, for storage of various articles. Often, a pallet is designed specifically to support a particular article or articles. Also, some pallets are adapted to be stacked one upon the other, in order to minimize the floor space which is occupied by the pallets. Stacking pallets is feasible only where equipment adapted to lift the pallets for stacking is available.

In manufacturing businesses in which mass production techniques are employed, it is often necessary that finished workpieces be introduced into an assembly line (e.g., for the assembly of automobiles) at a certain point. In order to achieve the introduction of workpieces into the assembly line in the most efficient manner possible, manufacturers often require that the finished workpieces be provided at the assembly line positioned in a particular manner on a pallet. Also, each pallet holding the finished workpieces typically is uniform, and in a specific configuration for ease of handling at the assembly line. This enables the manufacturer to set up a method for unloading the workpieces from the standard pallet which is repeated while the assembly line is in operation.

In addition, manufacturers often rely upon third party suppliers to manufacture a particular workpiece, in whole or in part. This is done where a supplier can perform one or more steps in the manufacture of a certain workpiece at a unit cost significantly lower than the manufacturer's unit cost. In these circumstances, the manufacturer typically provides the raw materials (e.g., semi-processed workpieces) to the third party supplier positioned on the manufacturer's standard pallet. The manufacturer also typically requires that the supplier is to return the standard pallet, with the finished workpieces positioned thereon in the manufacturer's predetermined position, once the supplier has done the work required on the workpieces.

Another aspect of this procedure is the recent adoption by many manufacturers of "just-in-time" delivery of parts by suppliers. Often, the third party supplier is obligated to provide a relatively large volume of finished workpieces on relatively short notice. In practice, suppliers are required to maintain relatively high levels of finished inventory. In these circumstances, if the manufacturer's standard pallet is not stackable, then the finished inventory occupies a relatively large amount of floor space in the supplier's plant.

A typical standard manufacturer's pallet 10 of the prior art is shown in FIGS. 1 and 1A, with workpieces 12 positioned thereon, in a predetermined position. FIG. 1A is a side view of a portion of the standard manufacturer's pallet 10 of the prior art and a stack 14 of workpieces 12 showing the pallet 10 on a floor 15.

It will be appreciated that the workpieces 12 are held in a stack and in a predetermined position on the standard manufacturer's pallet 10 by a series of clamps 16 and upright bars 17 which are generally maintained in position by means of fasteners such as nuts and bolts, as is known in the art. The standard manufacturers' pallet suffers from a number of disadvantages. For example, standard manufacturers' pallets are not generally stackable. Also, positioning the stack 14 on the standard manufacturer's pallet 10 can be awkward, as the clamps 16 and upright bars 17 are inconvenient to tighten and loosen.

There exists a need for a pallet system having a pallet system for maintaining a stack of substantially uniform workpieces in alignment with each other.

SUMMARY OF THE INVENTION

In a broad aspect of the present invention, there is provided a pallet system for maintaining a stack of substantially uniform workpieces in alignment with each other, each workpiece being defined by at least three sides. The stack has at least three side planes defined by the at least three sides of the workpieces in the stack. The pallet system includes a pallet having a base, a rigid stake projecting upwardly from the base, and an adjustable stake also projecting upwardly from the base. The base includes a frame which supports a plurality of base members for supporting the stack of workpieces. The base members are positioned substantially parallel to each other to define slots in the base. The rigid stake is adapted to locate a first side plane of the stack in a first predetermined position in relation to the base. The adjustable stake is adapted to locate a second side plane of the stack in a second predetermined position in relation to the base. The rigid stake is spaced from the adjustable stake so that the stack is located in a selected position on the base between the rigid stake and the adjustable stake.

In another aspect, the adjustable stake includes a stationary inner portion defined by at least one wall projecting upwardly from the base and a sleeve portion disposed adjacent to the inner portion and partially positionable between the inner portion and the second side plane of the stack when the stack is on the base. The sleeve portion is movable relative to the inner portion between a released position, in which the sleeve portion is spaced a distance apart from the second side plane of the stack, and a contact position, in which the sleeve portion is engageable with the second side plane of the stack. The sleeve portion is in this way adapted for locating the second side plane of the stack in the second predetermined position in relation to the base.

BRIEF DESCRIPTION OF THE DRAWINGS

The invention can be better understood by reference to the attached drawings, in which.

DETAILED DESCRIPTION OF THE PREFERRED EMBODIMENT(S)

Figure 1:
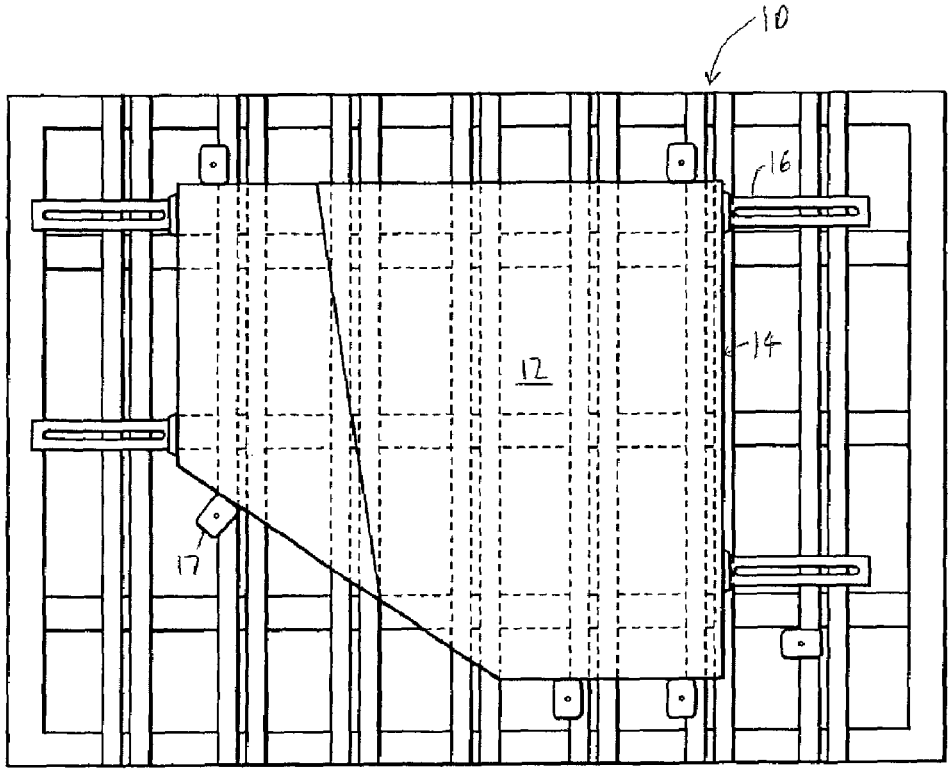
FIG. 1 (Prior Art)
FIG. 1 (also described previously) is a top view of a prior art standard manufacturer's pallet with a stack of workpieces positioned thereon.
Figure 1A:
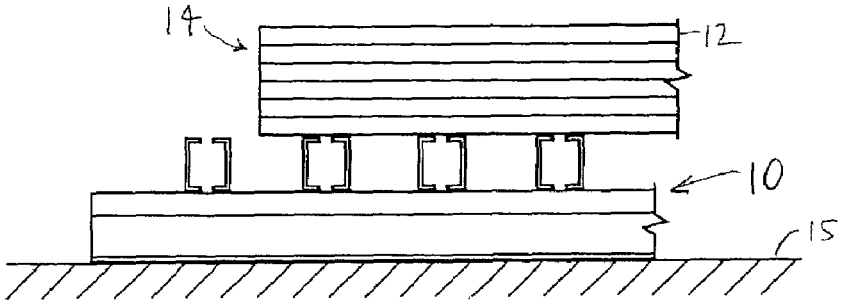
FIG. 1A (Prior Art)
FIG. 1A (also described previously) is a partial side view of the pallet of FIG. 1, showing part of the stack of workpieces positioned thereon.
Figure 2:
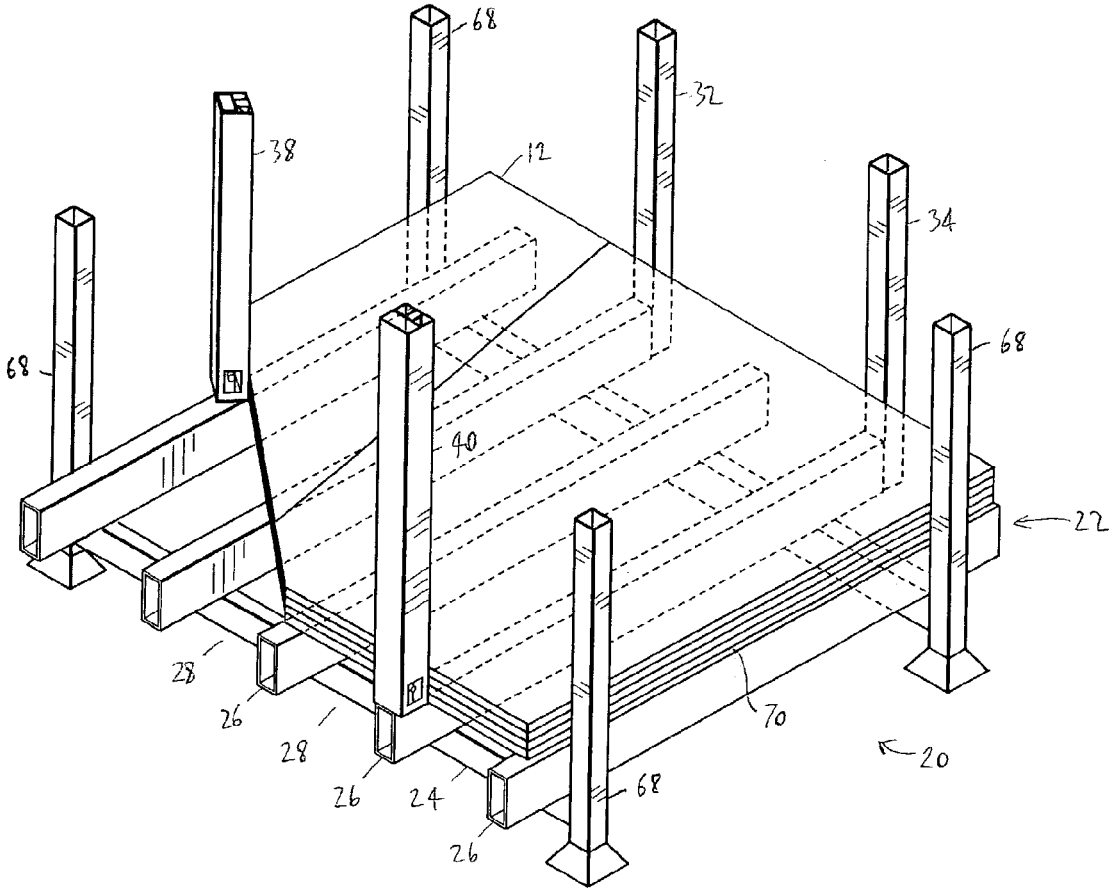
FIG. 2 is an isometric view of a preferred embodiment of the pallet of the invention with a stack of workpieces positioned thereon.
Figure 2B:
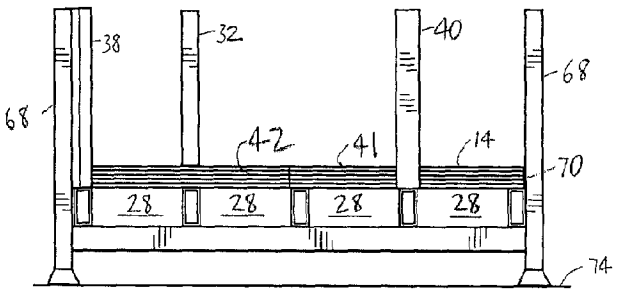
FIG. 2B is a front view of the pallet of FIG. 2.
Figure 2C:
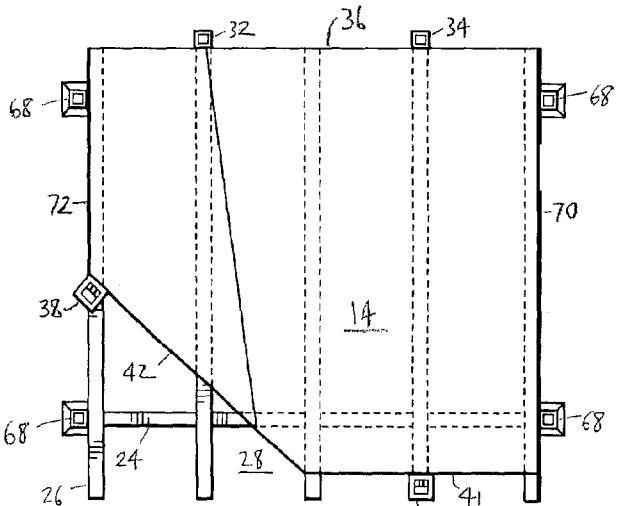
FIG. 2C is a top view of the pallet of FIG. 2.

Reference is first made to FIGS. 2, 2A, 2C, and 3 to describe the preferred embodiment of a pallet system indicated generally by the numeral 18 (FIG. 3) in accordance with the invention. As can be seen in FIG. 2, the pallet system 18 includes a pallet 20 with a base 22 including a frame 24. The frame 24 supports a plurality of base members 26 for supporting the stack of workpieces 12. Preferably, the base members 26 are positioned substantially parallel to each other to define slots 28 in the base 22. As can also be seen in FIG. 2, the pallet 20 also preferably includes two rigid stakes 32, 34 projecting upwardly from the base 22. The rigid stakes 32, 34 are adapted to locate a first side plane 36 of the stack 14 (FIG. 2A) in a predetermined position in relation to the base 22. The first side plane 36 is defined by aligned sides of the workpieces 12 (FIG. 2A) in the stack. The pallet 20 also includes stakes 38, 40 which are adjustable, as will be described. The stakes 38, 40 project upwardly from the base 22 and are adapted to locate side planes 41, 42 of the stack 14 respectively in predetermined positions in relation to the base 22, as shown in FIG. 2C. It can also be seen in FIG. 2 that the stakes 32, 34 are spaced from the stakes 38, 40 so that the stack 14 is locateable in a selected position on the base 22 between the stakes 32, 34 and the stakes 38, 40 respectively.

Figure 2A:
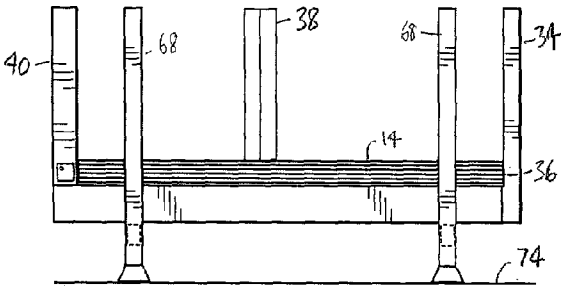
FIG. 2A is a side view of the pallet of FIG. 2, drawn at a smaller scale.
Figure 2D:
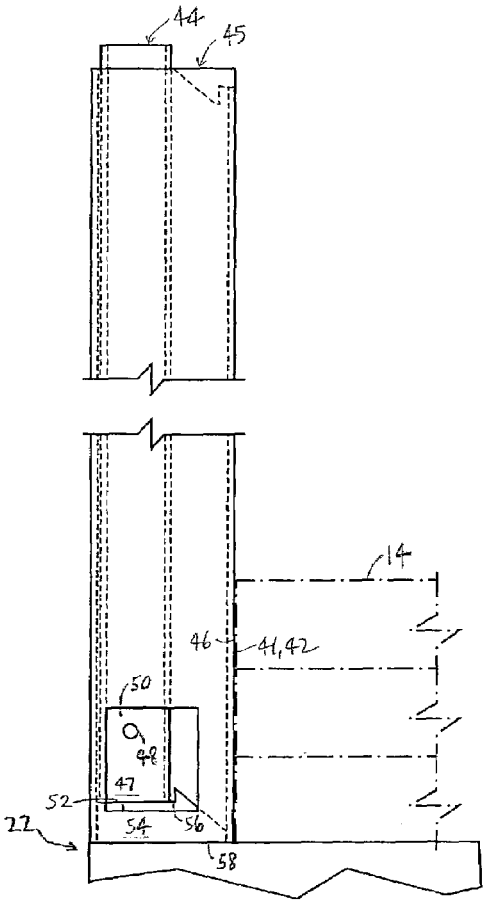
FIG. 2D is a partial cross-section taken from the side of an adjustable stake, showing a sleeve portion in a contact position, drawn at a larger scale.
Figure 2F:
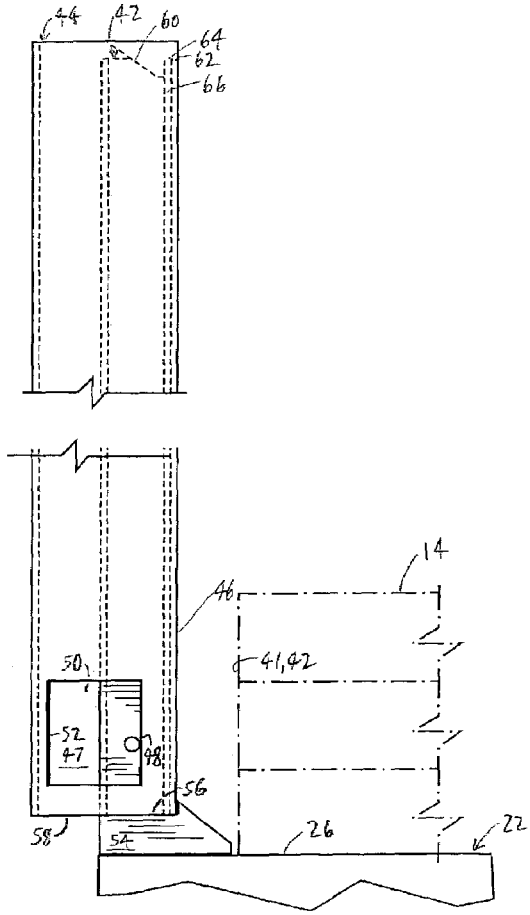
FIG. 2F is a partial cross-section taken from the side of the adjustable stake of FIG. 2D, showing the sleeve portion in a released position.
Figure 2E:
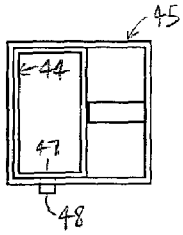
FIG. 2E is a top view of the adjustable stake of FIG. 2D.

Preferably, and as can be seen in FIGS. 2D, 2E, and 2F, each adjustable stake 38, 40 includes a stationary inner portion 44 projecting upwardly from the base 22 and a sleeve portion 45 disposed adjacent to the inner portion 44. As will be described, an engagement part 46 of the sleeve portion 45 is positionable between the inner portion 44 and side planes 41, 42 of the stack 14. Preferably, each of the inner portion 44 and the sleeve portion 45 comprises tubular steel, square in cross-section with rounded corners, or other suitable materials. Also, the sleeve portion 45 includes a wall 47 extending upwardly from the base 22 (FIGS. 2D, 2F). The sleeve portion 45 is movable relative to the inner portion 44 between a released position (shown in FIG. 2F), in which the sleeve portion 45 is spaced a distance apart from side planes 41, 42 of the stack 14, and a contact position (shown in FIG. 2D), in which the sleeve portion 45 is engageable with side planes 41, 42 of the stack 14. It can be seen in FIG. 2D that, when the sleeve portion 45 is in the contact position, the sleeve portion 45 locates side planes 41, 42 in a predetermined position in relation to the base 22.

As can be seen in FIGS. 2D, 2E, and 2F, in the preferred embodiment, the inner portion 44 includes a stop 48 projecting from the wall 47 of the inner portion 44. The sleeve portion 45 includes an aperture 50 for receiving the stop 48, the aperture 50 being defined by an edge 52. As is best shown in FIG. 2F, the stop 48 is positioned to abut the edge 52 to limit movement of the sleeve portion 44 from the contact position to the released position. Because of this, the stop 48 prevents the sleeve portion 45 from being pulled off the inner portion 44 when the sleeve portion 45 is moved between the contact position and the released position.

Preferably, the inner portion 44 also includes a step part 54 which includes a platform 56 disposed above the base members 26, onto which the sleeve portion 45 is positionable. As can be seen in FIGS. 2D and 2F, a bottom surface 58 of the sleeve portion 45 is adapted to cooperate with the platform 56 so that the sleeve portion 45 is maintainable in the released position by the platform 56. The step part 54 of the inner portion is welded or otherwise suitably fastened to the base 22.

It is also preferred that the sleeve portion 45 additionally includes a latch 60, positioned at a top end 62 of the sleeve portion 45 distal to the base 22. The latch 60 includes a groove 64 adapted to cooperate with the inner portion 44 to maintain the sleeve portion 45 in the released position. As can be seen in FIGS. 2D and 2F, in the preferred embodiment, a second wall 66 forming part of the inner portion 44 and formed substantially transverse to the wall 47 is receivable in the groove 64, to maintain the sleeve portion 45 in the released position.

FIG. 2 shows that the pallet 20 preferably additionally includes a plurality of substantially vertical legs 68 supporting the base 22. In the preferred embodiment, in addition to supporting the base 22 above a floor, the legs 68 extend upwardly from the base 22 to locate side planes 70, 72 of the stack 14 on the base 22 (FIGS. 2, 2A, 2B, 2C, and 2G).

It will be apparent to those skilled in the art that the pallet 20 can be used with a stack of workpieces of any configuration. Due to the particular shape of the workpieces 12 shown in the drawings, the stack 14 includes the side planes 41, 42 which are located on the base 22 by the adjustable stakes 38, 40. However, the workpieces 12 can have a variety of side planes (not shown) accordingly when the workpieces 12 are arranged in the stack 14.

Figure 2G:
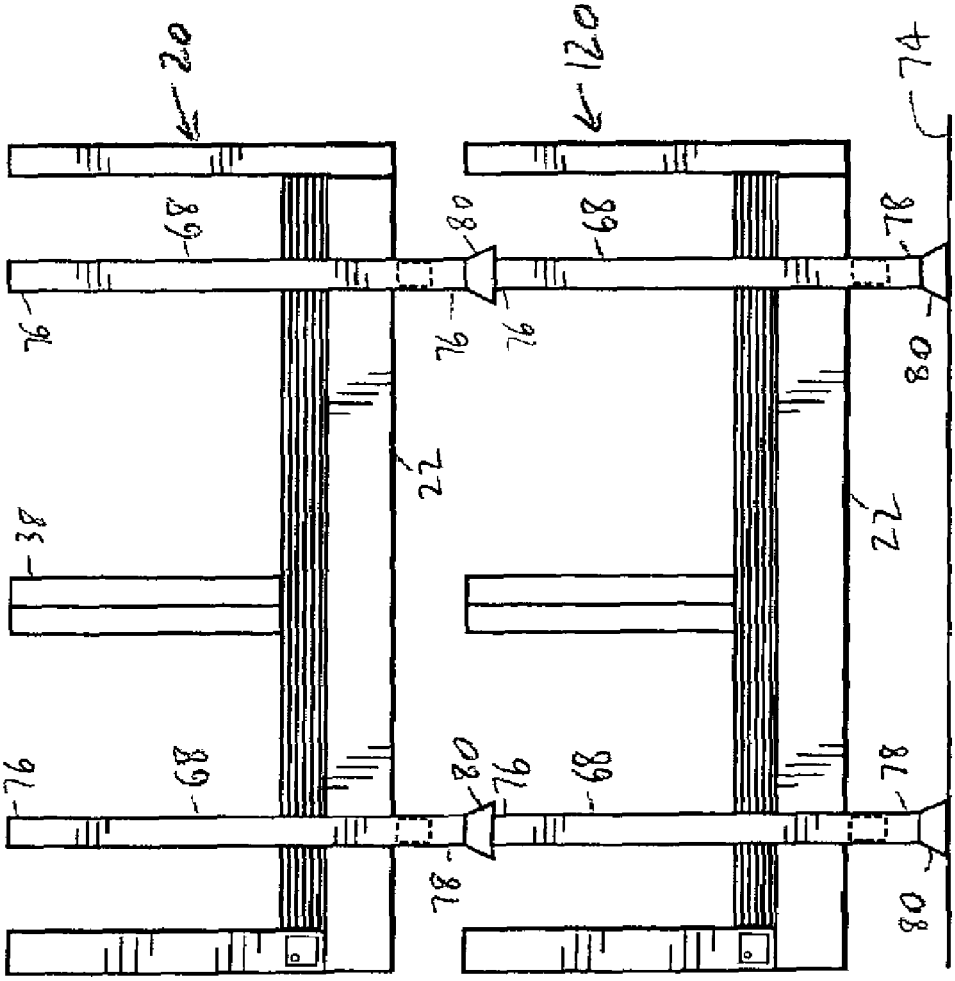
FIG. 2G is a side view of the pallet of FIG. 2, supporting a second pallet, drawn at a smaller scale.

Preferably, and as can be seen in FIGS. 2A and 2B, the legs 68 are adapted to support the base 22 above a floor 74. It is also preferred that each leg 68 includes an upper end 76 distal to the base 22 and a lower end 78 distal to the upper end and terminating in a foot plate 80. The foot plate 80 is adapted to receive the upper end 76 of a leg 68 of a second pallet 120 positioned under the pallet 20, as can be seen in FIG. 2G. In this way, the pallet 20 is supportable by the second pallet 120.

Similarly, the upper ends 76 of the leg 68 of the pallet 20 are adapted to cooperate with foot plates (not shown) of a third pallet (not shown) so that the third pallet is supportable by the legs 68 of the pallet 20.

It is preferred that the pallet system 18 also includes a lift device 82, shown in FIGS. 3, 3A, 3B, 3C, 4, and 5. As will be described, the lift device 82 is for lifting the stack 14 off the base 22 of the pallet 20. In the preferred embodiment, the lift device 82 is suspended from an overhead crane having a hook 83 from which the lift device 82 is suspended by cables 84, as is known in the art.

Preferably, the lift device 82 includes a body 86 and at least two forks 88 extending in a forward direction (indicated by arrow "F" in FIG. 3) from the body 86. The forks 88 are spaced apart such that the forks 88 are receivable in slots 28 in the base 22 of the pallet 20.

As can be seen in FIGS. 3, 3A, 3B, 3C, and 4, the forks 88 preferably include front ends 90 positioned distal to the body 86. The lift device 82 also includes an upper portion 92 spaced apart from the forks 88 and extending in the forward direction from the body 86 over the forks 88 to a front part 93 positioned substantially above the front ends 90 of the forks 88. The upper portion 92, the body 86, and the forks 88 define a cavity 94 for receiving the stack. The lift device 82 preferably additionally includes a front gate 96 pivotally attached to the upper portion 92 at the front part 93 and movable between an open position (FIG. 3), in which the stack 14 is receivable in the cavity 94, and a closed position (FIGS. 3A, 3C), in which the gate 96 is engageable with the stack 14 when the stack 14 is disposed in the cavity 94. The gate 96 serves the purpose of locating the stack 14 in the cavity 94.

Figure 3:
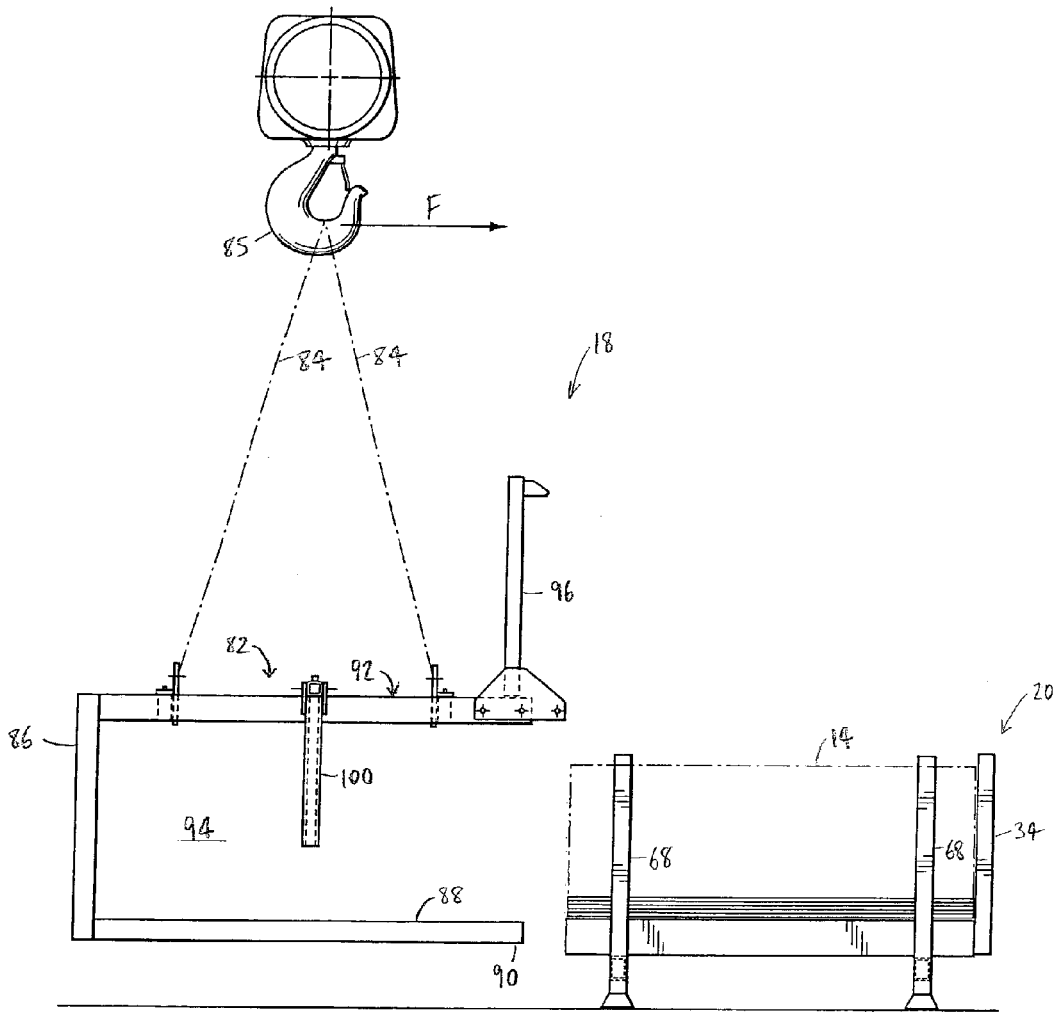
FIG. 3 is a side view of a preferred embodiment of the lift device of the invention with the stack of workpieces on the pallet of FIG. 2 to be received in the lift device.
Figure 3A:
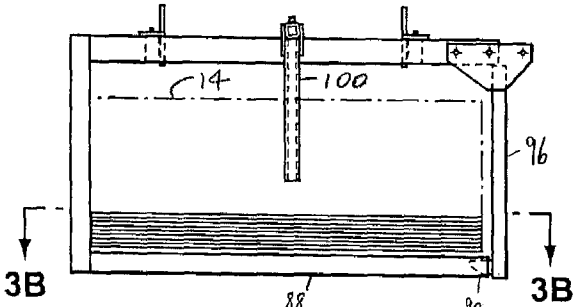
FIG. 3A is a side view of the lift device of FIG. 3 with the stack of workpieces received therein, drawn at a smaller scale.
Figure 3C:
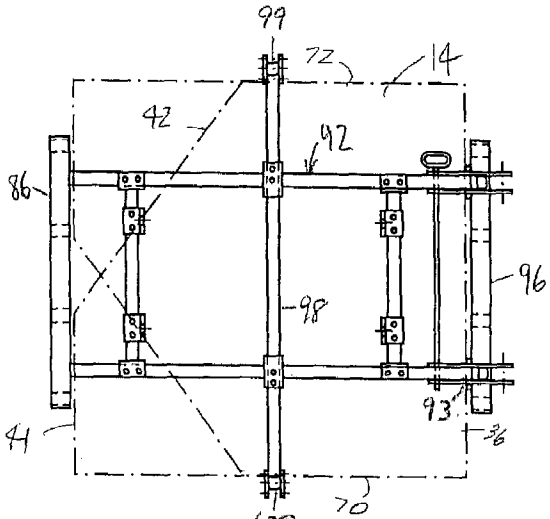
FIG. 3C is a top view of the lift device of FIG. 3 showing the stack of workpieces received therein.
Figure 3B:
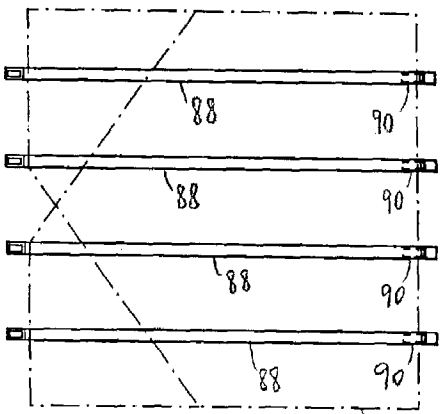
FIG. 3B is a bottom view of the lift device of FIG. 3 showing the stack of workpieces received therein.

As can be seen in FIG. 3C, the side plane 41 is located in the cavity 94 by the body 86. This is the result of the lift device 82 moving towards the stack 14 on the pallet 20 in the direction shown by the arrow "A" in FIG. 2C until the side plane 41 abuts the body 86. In addition, as can also be seen in FIG. 3C, the side plane 36 abuts the gate 96 when the gate 96 is in the closed position.

Preferably, each of the front ends 90 of the forks 88 is hollow, and teeth 97 on the gate 96 are receivable in the front ends 90, to assist in maintaining the gate 96 in the closed position (FIG. 3A). It is also preferred that the gate 96 be maintained in the closed position by a simple lock means 95 positioned on the upper portion 92.

As can also be seen in FIG. 3C, the upper portion 92 of the lift device 82 includes a cross bar 98. The upper portion 92 also includes arms 99, 100 pivotally attached at opposite ends of the cross bar 98, each arm 99, 100 being movable between a released position, in which the stack 14 is receivable in the cavity 94, and an engaged position (FIGS. 3A, 3C), in which the arms 99, 100 locate the side planes 72, 70 respectively of the stack 14 in the cavity 94. Preferably, the arms 99, 100 are maintained in the engaged position by a simple lock means (not shown).

The pallet 20 can be made of any suitable materials. However, it is preferred that the frame 24 and the base members 26 comprise suitably proportioned lengths of steel tubing (rectangular and/or square in cross-section), welded or otherwise fastened together by any suitable means. The rigid stakes 32, 34, and the legs 68 are also welded or otherwise secured by any suitable means to the base 22.

In use, before the stack 14 is placed on the pallet 20, the sleeve portions 45 of the adjustable stakes 38, 40 are moved to the contact position (FIG. 2D). The finished workpieces 12 are then placed on the pallet 20 to form the stack 14. The engagement parts 46 of the sleeve portions 45 engage the side planes 41, 42 of the stack 14 and the stack 14 is thereby held snugly in position on the pallet 20. The pallet 20 may be stacked on top of other pallets 120 by an industrial lift truck (not shown) or other suitable means, so that the finished inventory can occupy less floor space. In order for the lift device 82 to remove the stack from the pallet 20, the pallet 20 needs to be positioned on the floor 74.

When the stack 14 is to be removed from the pallet 20, the sleeve portions 45 of the adjustable stakes 38, 40 are each moved to the released position. This makes it possible to lift the stack 14 off the pallet 20.

Next, with the gate 96 of the lift device 82 in the open position, the crane moves the lift device 82 substantially horizontally to the pallet 20, with the forks 88 aligned with the slots 28 so that the forks 88 can be inserted to be positioned substantially cross the bottom of the stack 14, so that the stack 14 is positioned substantially in the cavity 94.

Figure 4:
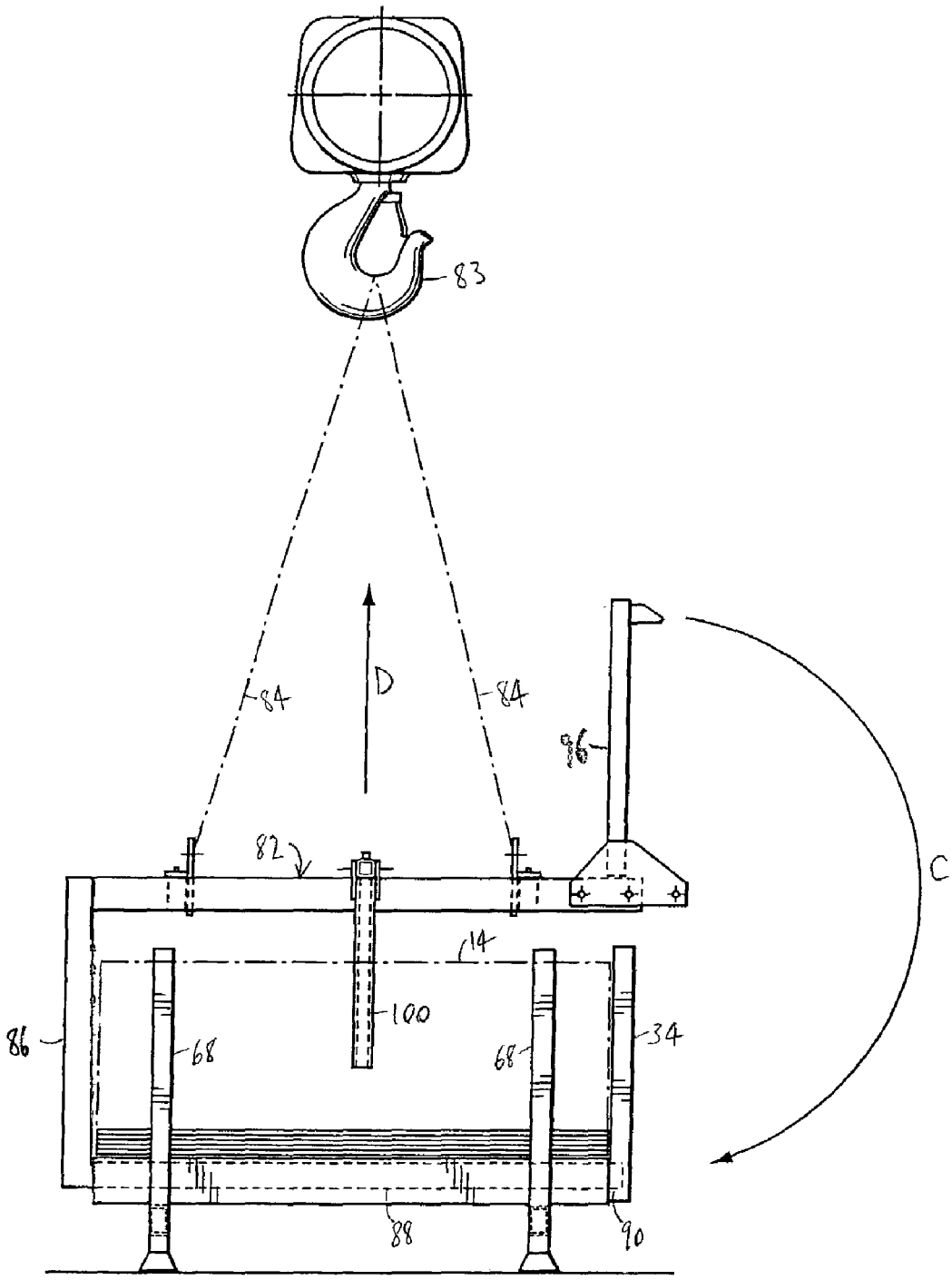
FIG. 4 is a side view of the lift device of FIG. 3 showing the stack of workpieces received therein, drawn at a larger scale.
Figure 5:
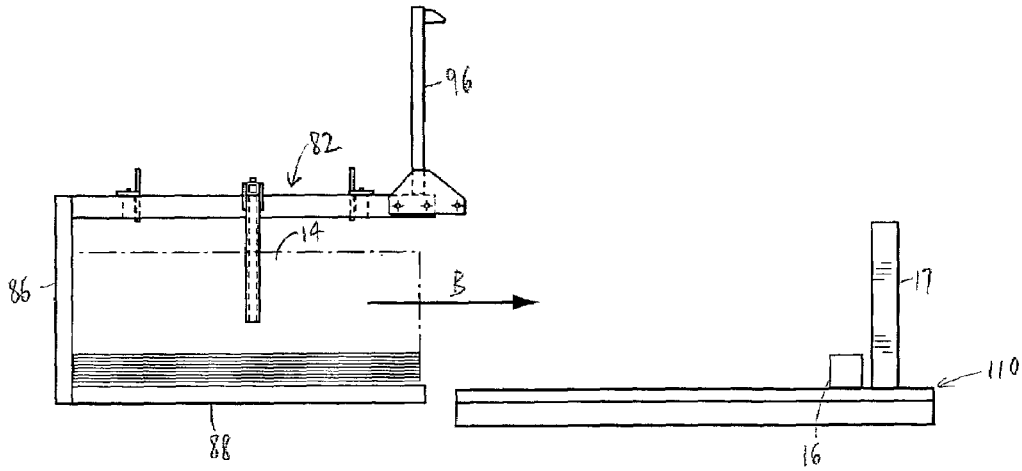
FIG. 5 is a side view of the lift device of FIG. 4 positioned adjacent to the standard manufacturer's pallet prior to placement of the stack thereon, drawn at a smaller scale.
Figure 6:
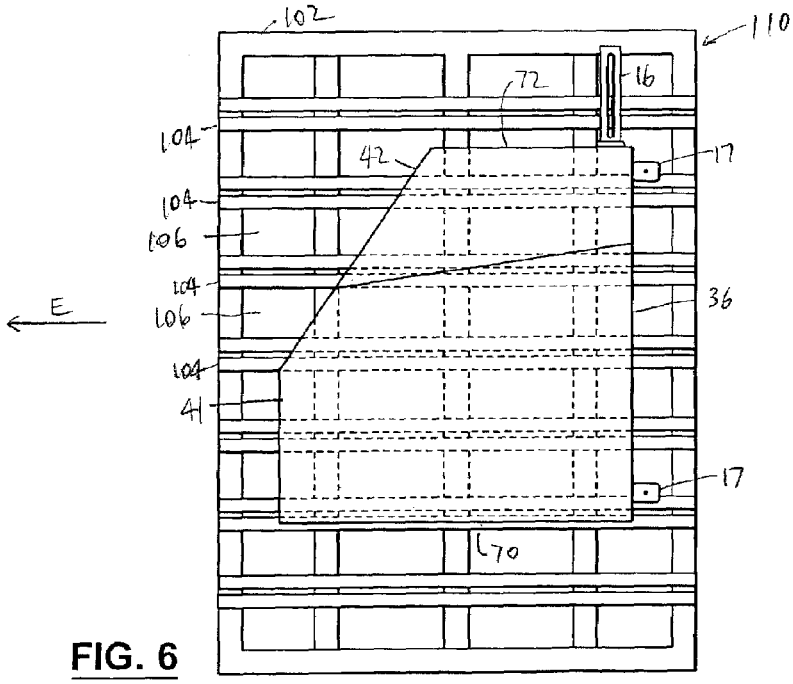
FIG. 6 is a top view of the standard manufacturer's pallet of FIG. 1, drawn at a smaller scale.

As can be seen in FIG. 4, once the stack 14 is positioned in the cavity 94 of the lift device 82, the gate 96 is swung in a downward arc (shown by arrow "C" in FIG. 4) to close the gate 96, and the crane lifts the lift device 82 substantially directly upward, in the direction shown by arrow "D" in FIG. 4, until the lift device 82 clears the rigid stakes 32, 34 and the adjustable stakes 38, 40. The crane then moves the lift device 82, with the stack 14 securely located in the cavity 94, to a standard manufacturer's pallet 110 prepared to receive the stack 14. As can be seen in FIG. 6, the standard manufacturer's pallet 110 includes a frame 102 and frame members 104 to support the stack 14. The frame members 104 are positioned substantially parallel to each other and spaced apart from each other to define slots 106.

In the preferred embodiment, the gate 96 is moved to the open position shortly before the stack 14 is placed on the pallet 110. The lift device 82 is moved toward the pallet 110 in a substantially horizontal direction, indicated by arrow "B" in FIG. 5. The forks 88 are aligned in suitable slots 106 of the pallet 110, as required in order to position the side planes 72, 36 against the clamps 16 and the bars 17, as shown in FIG. 6. Preferably, the minimum number of clamps 16 and bars 17 is used to position the stack 14 in a final predetermined position (as shown in FIG. 6) on the manufacturer's pallet 110. In FIG. 6, it can be seen that, for the workpieces 12 shown, a 90 degree corner (i.e., where the side frames 72 and 36 meet) is defined by the clamp 16 and bar 17, and the position of the side plane 36 is determined by the bars 17. After the stack 14 is placed on the frame members 104, the lift device 82 is lowered and removed from the stack, being withdrawn in the direction shown by arrow "E" in FIG. 6.

Figure 7:
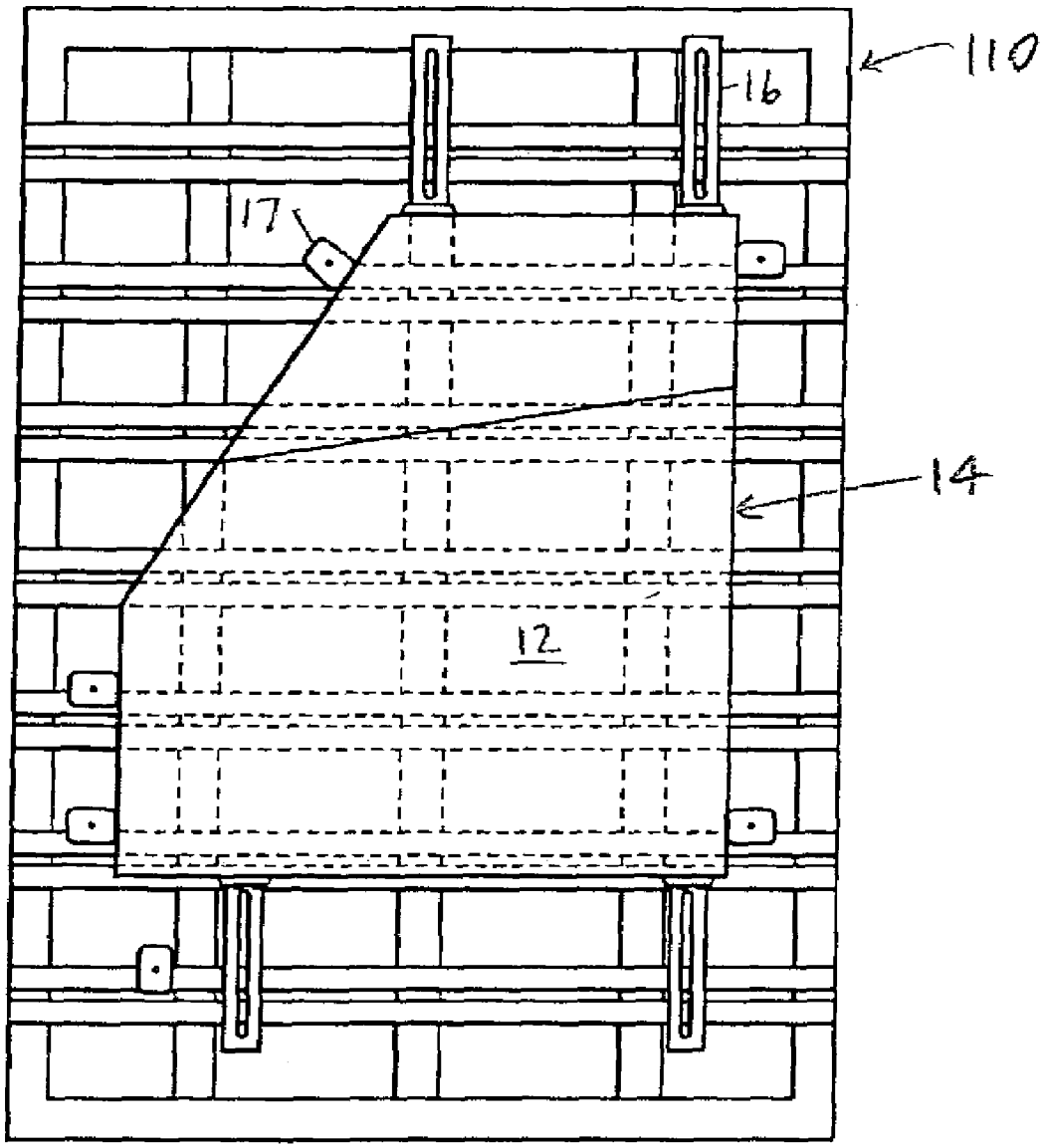
FIG. 7 is a top view of the standard manufacturer's pallet with finished workpieces positioned thereon.

After the lift device 82 has been removed, additional clamps 16 and bars 17 are fastened to the pallet 110 in accordance with the manufacturer's requirements to secure the stack 14 of workpieces 12 in the final predetermined position on the manufacturer's pallet 110 (FIG. 7). Once the stack 14 is in the final predetermined position on the manufacturer's pallet 110 with all required clamps 16 and bars 17 fastened in place as shown in FIG. 7, the manufacturer's pallet 110 and the stack 14 of workpieces 12 re ready for shipment to the manufacturer.

The above-described embodiments of the present invention are intended to be examples only. Alterations, modifications and variations may be effected to the embodiments described above by those skilled in the art without departing from the scope of the invention, which is defined solely by the claims appended hereto.

I claim:

1. A pallet system for maintaining a stack of substantially uniform workpieces in alignment with each other, each said workpiece being defined by at least three sides, the stack having at least three side planes defined by said at least three sides of the workpieces in the stack, the pallet system including a pallet comprising:

a base comprising a frame, the frame supporting a plurality of base members for supporting the stack of workpieces, the base members being positioned substantially parallel to each other to define at least two slots in the base;

at least one rigid stake projecting upwardly from the base, said at least one rigid stake being adapted to locate a first side plane of the stack in a first predetermined position in relation to the base;

at least one adjustable stake projecting upwardly from the base, said at least one adjustable stake being adapted to locate a second side plane of the stack in a second predetermined position in relation to the base;

said at least one rigid stake being spaced from said at least one adjustable stake such that the stack is located in a selected position on the base between said at least one rigid stake and said at least one adjustable stake;

said at least one adjustable stake comprising:

a stationary inner portion defined by at least one wall projecting upwardly from the base;

a sleeve portion disposed adjacent to the inner portion and at least partially positionable between the inner portion and the second side plane of the stack when the stack is on the base; and the sleeve portion being movable relative to the inner portion between a released position, in which the sleeve portion is spaced a distance apart from the second side plane of the stack, and a contact position, in which the sleeve portion is engageable with the second side plane of the stack, for locating the second side plane of the stack in the second predetermined position in relation to the base.

2. A pallet system according to claim 1 in which the inner portion comprises a stop projecting from the inner portion and the sleeve portion includes an aperture for receiving the stop, the aperture being defined by an edge around the aperture, the stop being positioned on the inner portion to abut the edge to limit movement of the sleeve portion from the contact position to the released position such that the sleeve portion is held adjacent to the inner portion when the sleeve portion is in the released position.

3. A pallet system according to claim 1 in which the inner portion comprises a step part with a platform elevated above the base members onto which the sleeve portion is positionable, such that the sleeve portion is maintained in the released position by the platform.

4. A pallet system according to claim 1 in which the sleeve portion comprises a latch at a top end of the sleeve portion disposed distal to the base, the latch including a groove for cooperating with the inner portion to maintain the sleeve portion in the released position.

5. A pallet system according to claim 1 additionally comprising a lift device for lifting the stack off the base, the lift device comprising:

a body;

at least two forks extending in a forward direction from the body, said at least two forks being spaced apart such that said at least two forks are receivable in said at least two slots in the base of the pallet;

said at least two forks comprising front ends positioned distal to the body;

the lift device comprising an upper portion spaced apart from said at least two forks and extending in the forward direction from the body over said at least two forks to a front part positioned substantially above the front ends;

the upper portion and said at least two forks defining a cavity for receiving the stack; and the lift device additionally comprising a front gate pivotally attached to the upper portion at the front part and movable between an open position, in which the stack is receivable in the cavity, and a closed position, in which the gate is engageable with the stack when the stack is disposed in the cavity, to locate the stack in the cavity.

6. A pallet system according to claim 5 in which the body is adapted to locate the second side plane of the stack in a predetermined relationship to said at least two forks when the stack is disposed in the cavity and the front gate is adapted to locate the first side plane of the stack in a predetermined relationship to said at least two forks when the stack is disposed in the cavity and the front gate is in the closed position.

7. A pallet system according to claim 5 in which the lift device comprises at least one arm, said at least one arm being pivotally attached to the upper portion for pivotal movement transverse to said at least two forks, said at least one arm being movable between a released position, in which the stack is receivable in the cavity, and an engaged position, in which said at least one arm engages the stack, to locate the stack in the cavity.

8. A pallet for supporting a stack of substantially uniform workpieces in alignment with each other, each said workpiece being defined by at least three sides, the stack having at least three side planes defined by said at least three sides of the workpieces in the stack, the pallet comprising:

a base comprising a frame, the frame supporting a plurality of base members for supporting the stack of workpieces, the base members being positioned substantially parallel to each other, each side base member being spaced apart from each adjacent said base member a predetermined distance;

at least one rigid stake projecting upwardly from the base, said at least one rigid stake being adapted to locate a first side plane of the stack in a first predetermined position in relation to the base;

at least one adjustable stake projecting upwardly from the base, said at least one adjustable stake being adapted to locate a second side plane of the stack in a second predetermined position in relation to the base;

said at least one rigid stake being spaced from said at least one adjustable stake such that the stack is locateable in a selected position on the base between said at least one rigid stake and said at least one adjustable stake;

said at least one adjustable stake comprising:

a stationary inner portion defined by at least one wall projecting upwardly from the base, the stationary inner portion being positioned a selected distance from the second predetermined position of the second side plane of the stack;

a sleeve portion disposed adjacent to the inner portion and having an engagement part, the engagement part being receivable in the selected distance between the inner portion and the second side plane of the stack when the second side plane is disposed in the second predetermined position; and the sleeve portion being movable relative to the inner portion between a released position, in which the engagement part of the sleeve portion is disengaged from the second side plane of the stack, and a contact position, in which the engagement part abuts the second side plane of the stack, to locate the second side plane of the stack in the second predetermined position on the base.

9. A lift device for lifting a stack of substantially uniform workpieces from a first pallet, transporting the stack to a receiving pallet, and positioning the stack on the receiving pallet, the first pallet including at least two slots positioned adjacent to the stack, the lift device comprising:

a body;

at least two forks extending in a forward direction from the body, said at least two forks being spaced apart such that said at least two forks are receivable in said at least two slots in the first pallet;

said at least two forks including front ends positioned distal to the body;

an upper portion spaced apart from said at least two forks and extending in the forward direction from the body over said at least two forks to a front part positioned substantially above the front ends;

the upper portion and said at least two forks defining a cavity for receiving the stack; and a front gate pivotally attached to the upper portion at the front part and movable between an open position, in which the stack is receivable in the cavity, and a closed position, in which the gate is engageable with the stack when the stack is disposed in the cavity, to locate the stack in the cavity.

10. A lift device according to claim 9 additionally comprising at least one arm, said at least one arm being pivotally attached to the upper portion of the lift device for pivotal movement transverse to said at least two forks, said at least one arm being movable between a released position, in which the stack is receivable in the cavity, and an engaged position, in which said at least one arm engages a third side plane of the stack, to locate the stack in the cavity.

11. A method of storing and moving a stack of substantially uniform workpieces in alignment with each other, each said workpiece being defined by at least three sides, the stack having at least three side planes defined by said at least three sides of the workpieces in the stack, the method comprising the steps of:

(a) placing the stack on a first pallet, the first pallet comprising:

a base including a base supporting a plurality of base members defining at least two slots in the base;

at least one rigid stake projecting upwardly from the base, said at least one rigid stake being adapted to locate a first side plane of the stack in a first predetermined position in relation to the base;

at least one adjustable stake projecting upwardly from the base, said at least one adjustable stake being adapted to locate a second side plane of the stack in a second predetermined position in relation to the base;

said at least one rigid stake being spaced apart from said at least one adjustable stake such that the stack is locateable in a selected position on the base between said at least one rigid stake and said at least one adjustable stake;

(b) moving a lift device into position to engage the stack on the first pallet, the lift device comprising:

a body;

at least two forks extending in a forward direction from the body, said at least two forks being spaced apart such that said at least two forks are receivable in said at least two slots in the first pallet;

said at least two forks including front ends positioned distal to the body;

an upper portion spaced apart from said at least two forks and extending in a forward direction from the body over said at least two forks to a front part positioned substantially above the front ends;

the upper portion and said at least two forks defining a cavity for receiving the stack;

a front gate pivotally attached to the upper portion at the front part and movable between an open position, in which the stack is receivable in the cavity, and a closed position, in which the gate is engageable with the stack when the stack is disposed in the cavity to locate the stack in the cavity;

(c) receiving the stack in the cavity of the lift device;

(d) lifting the stack off the pallet with the lift device;

(e) moving the front gate on the lift device to the closed position, to retain the stack in the cavity;

(f) moving the lift device to a receiving pallet having at least two slots for receiving said at least two forks of the lift device;

(g) moving the front gate to the open position to permit the discharge of the stack from the cavity in the lift device;

(h) lowering the lift device to place the stack onto the receiving pallet and to position the stack in a final predetermined position on the receiving pallet, by inserting said at least two forks of the lift device into said at least two slots in the receiving pallet as the lift device is lowered; and (i) removing the lift device from the receiving pallet by withdrawing said at least two forks from said at least two slots in the receiving pallet.

12. A method according to claim 11 comprising the additional step, following step (h), of abutting the stack against at least three positioning means to place the stack in the final predetermined position on the receiving pallet.

* * * * *